United States Patent [19]

Inoue

[11] Patent Number: 4,777,816

[45] Date of Patent: Oct. 18, 1988

[54] ROLL BENDING MACHINE

[75] Inventor: Yasutaka Inoue, Tokyo, Japan

[73] Assignee: Inoue Sangyo Co. Ltd., Tokyo, Japan

[21] Appl. No.: 62,426

[22] Filed: Jun. 16, 1987

[30] Foreign Application Priority Data

Sep. 3, 1986 [JP] Japan ..... 61-206017
Dec. 22, 1986 [JP] Japan ..... 61-303881

[51] Int. Cl.[4] ..... B21D 5/14
[52] U.S. Cl. ..... 72/166
[58] Field of Search ..... 72/166, 173, 174, 169

[56] References Cited

U.S. PATENT DOCUMENTS 2,769,477 11/1956 Neer ..... 72/166
3,357,222 12/1967 Konstandt ..... 72/169
3,438,232 4/1969 Achler et al. ..... 72/166
4,063,442 12/1977 Martin, Sr. ..... 72/166

FOREIGN PATENT DOCUMENTS 562342 6/1977 U.S.S.R. ..... 72/166

*Primary Examiner*—Daniel C. Crane
*Attorney, Agent, or Firm*—Spencer & Frank

[57] ABSTRACT

The invention relates to a roll bending machine consisting of two rolls capable of adjusting the radius of curvature of the pressured roll, having a rotatable endless belt between the pressured roll and the works, forming the works not only into ring-shaped products of a desired diameter but also into involute-curved, spiral-shaped, elliptical-shaped, triangular-shaped (rounded), rectangular-shaped and other sophisticated curved products, providing a uniform finish to the works, meeting the size tolerance and desired diameter accuracy, eliminating any damage to the works.

21 Claims, 4 Drawing Sheets

ROLL BENDING MACHINE

BACKGROUND OF THE INVENTION

A roll bending machine consisting of two rolls (hereinafter referred to as the two-roll bending machine) capable of forming works or workpieces into arc- or ring-shaped products of desired diameter.

The conventional two-roll bending machine is of such basic constitution that one of the two adjacent rotatable rolls (hereinafter referred to as the pressured roll) comes under an adjustable pressure from the other of two rolls (hereinafter referred to as the pressure roll). To obtain an arc-shaped product in this system, the work is inserted and passed between the two rolls rotating under squeezing pressure, during which process the work is subjected to a converging pressure from the pressure roll in the direction of the pressured roll, thus undergoing a plastic deformation in such an arc as to wrap about the pressured roll.

In this conventional system, a pressured roll with a small diameter must be used to obtain a formed product of relatively small diameter, and a pressured roll of a large diameter to obtain the product of a relatively large diameter.

In obtaining formed products of the same diameter, however, the conventional system requires a number of pressured rolls of different diameters, depending on the variations in the material, hardness, shape (width, thickness), etc. of the works.

This is because there exists the following relationship between $\rho$: radius of the work during forming, $\rho$: radius of the work after the springback after forming (outward return of the arc), M: bending moment to work on the work, E: modulus of direct elasticity and I: second moment of area:

$$1/\rho', 1/92 - M/EI$$

Here, M, a variable, changes with the desired diameter, the material, hardness and shape (width, thickness) of the work as well as with the work hardening index and plasticity coefficient of the work. E, which is also a variable, changes with the material of the work. And I, another variable, changes with the shape (width, thickness) of the work. To obtain a formed product of a desired radius $\rho'$ after springback, therefore, it is necessary to change the radius $\rho$ of the work at forming, namely the radius $\rho$ of the pressured roll, for every variation in such factors as the material, hardness, shape (width, thickness) of the work which can in turn change M, E and I. Hitherto, however, changing the radius $\rho$ of a single pressured roll for every variation in the above-mentioned factors has been either beyond thought or considered impossible. Hence, a number of pressured rolls with different radii were prepared and for each variation in the factors a pressured roll of an appropriate radius was selected, or manufactured as required, to perform the forming operation.

Preparation of a number of pressured rolls with different radii as described above requires great expense while manufacture of pressured rolls with optimal radii calls for long experience and advanced technology.

Furthermore, it takes great trouble and time in actual operation to determine a correct radius for the pressured roll according to the delicately varying material, hardness, shape (width, thickness), etc. of the work and then select, or manufacture a necessary pressured roll using long experience and advanced technology. These are the greatest drawbacks found with the conventional two-roll bending machine, which have long awaited solution.

To solve the above-mentioned problems of the conventional two-roll bending machine, the inventor of this machine has devised a novel system as described below.

With the present invention, the work, passed between two rolls rotating under squeezing pressure, is formed into such an arc as wraps about one of the rolls and then, on the exit side where the work is released from the squeezing pressure, the work is subjected to a further forming by a pressure member with a different radius of curvature, provided between the work and the above-mentioned roll, which unbends the passing work to a certain degree.

The novel two-roll bending machine thus presents its practical benefit in the absence of pressured roll replacement conventionally required in obtaining a formed product of desired diameter in compensation for the slight variations in the material, hardness, shape (width, thickness), etc. of the work.

Also, by changing the position of the pressure member, the novel two-roll bending machine using a single pressured roll can produce formed products of the same desired diameter even when there are some variations in the material, hardness, shape (width, thickness), etc. of the works.

Further, the inventor of the present machine has invented the following device which not only solves the problems of the conventional two-roll bending machines but also makes improvements on the aforementioned system.

This improvement relates to a device capable of moving the point of contact between the pressure member and the work during operation in the two-roll bending machine which forms the work into such an arc as wraps about one of the rolls as it is passed between the two rolls rotating under squeezing pressure and then, on the exit side where the work is released from the squeezing pressure, subjects the work to a further forming as the passing work is unbended to a certain degree by a pressure member provided between the work and the above-mentioned roll. And this device makes it possible to build an automated system which, while using a single pressured roll, can produce formed products of a desired diameter.

In application of this device, however, the shape, especially the thickness, of the pressure member and the positioning of the pressure member in actual operation are subject to limitations, beyond which the progress of the forming operation is impeded.

In other words, the thicker the pressure member is, or the closer the pressure member is to the point of tangency between pressure roll and pressured roll during operation, the greater will be the degree at which the work is unbended. And if the pressure member is too thick, or if even a relatively thin pressure member is located too close to the above-mentioned point of tangency, the front end of the work will bump against the pressure member, thus impeding the forming operation.

Therefore, the shape, especially the thickness, of the pressure member and the position of the pressure member during operation have their limits, and the resulting diameter of formed products has its limit also.

In the inventor's test operation, to obtain formed products of a diameter larger than the above-mentioned limit, the work had to be inserted as far as where the front end of the work would not bump into the pressure member, before the squeezing pressure was applied between the pressure roll and the pressured roll, or the pressure member had to be first located in a raised position and then brought down into contact with the work after the front end of the work had passed it, to avoid collision between the front end of the work and the pressure member. That is, an additional work process was required.

Also with the aforementioned system, where the initial contact of the work with the pressure member is not continuous but sudden, it was found that the projection of the pressure member can sometimes damage the work and the pressure member itself is susceptible to wear.

SUMMARY OF THE INVENTION

An object of the invention is to provide a roll bending machine which has solved the aforesaid problems of the conventional two-roll bending machine.

Another object of the invention is to provide a roll bending machine which has overcome the aforesaid limitations of the system, which enables smooth operation irrespective of the shape, especially the thickness, of the pressure member and the position of the pressure member at the start of operation, which can produce formed products in larger arcs using the same system without requiring an additional work process, and which does not cause damage to the work or formed product and is free from wear of the pressure member.

DETAILED DESCRIPTION OF THE PREFERRED EMBODIMENT

The roll bending machine provided with the pressure member of this invention will now be described more specifically in terms of preferred embodiments thereof.

FIGS. 1 to 4 show a preferred embodiment of the horizontal-type two-roll bending machine provided with a pressure member.

Figure 1:
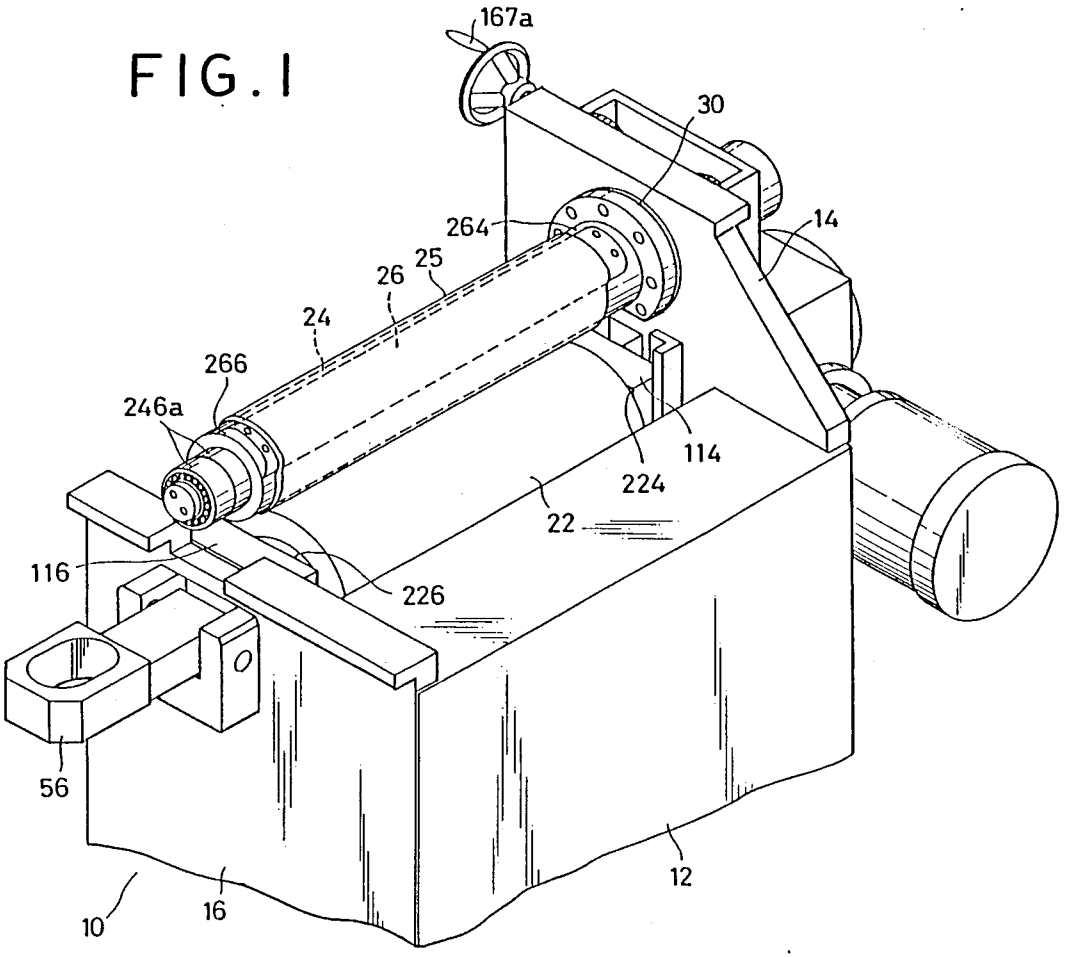
FIG. 1 is a perspective view showing an embodiment of the roll bending machine of this invention.
Figure 2:
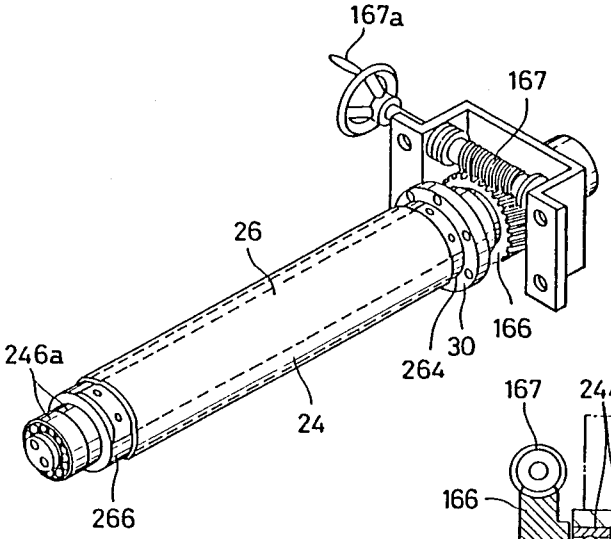
FIG. 2 is a perspective view showing the pressured roll equipped with the pressure member of the roll bending machine shown in FIG. 1.

Referring now to FIG. 1, there is shown a two-roll bending machine 10 comprising a pressure roll 22 in the lower position coated with urethane rubber so as to provide a elastic surface, a pressured roll 24 consisting of a rigid cylindrical roll and a pressure member 26 in the upper position and an iron frame 12, which consists of a base, stay and stands 14 and 16.

The pressure roll 22 and the shaft ends thereof 224 and 226 are rotatably supported by the roller bearings fitted in the sliding support members 114 and 116. These members 114 and 116, which can freely slide up and down, are supported by the guide rails provided in the stands 14 and 16 of the frame 12. The sliding support members 114 and 116 supporting the pressure roll 22 are operated up or down by a fluid pressure cylinder, and the shaft end 224 of the pressure roll 22 on the side of the stand 14 is rotated by a motor.

Figure 3:
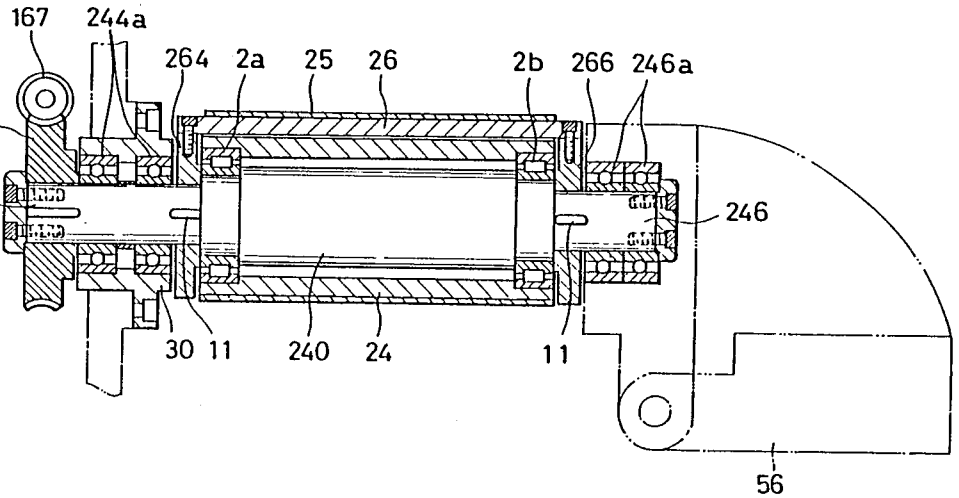
FIG. 3 is a section view of the roll bending machine of this invention.
Figure 4:
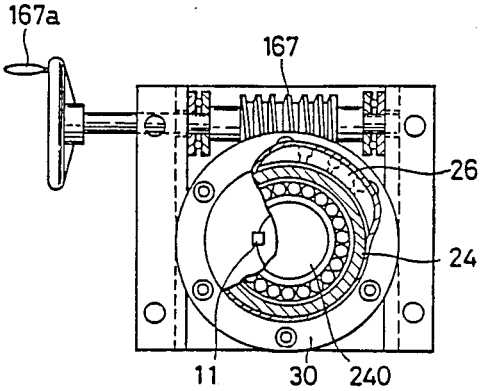
FIG. 4 is a partly broken-away side elevation of the roll bending machine of this invention shown in FIG. 1.

As seen in FIG. 3, the pressured roll 24 is rotatably supported by the support shaft 240 via bearings 2*a* and 2*b*.

The shaft end 244 of the support shaft 240 is held in the bearings 244*a* in the bearing housing 30 provided in the upper part of the stand 14. The other shaft end 246 is supported via the bearings 246*a* fitted on the outside by the upper part of the attachable/detachable drop end member 56. The lower part of the drop end member 56, held by a swing support pin, enables the member to swing and attach to or detach from the shaft end 246 of the support shaft 240 as operated by the fluid pressure cylinder.

Fitted on the support shaft 240 at both the ends of the pressured roll 24 are the support rings 264 and 266, peripheries of which support the pressure member 26 which is a steel plate having a crescent-moon cross section. These support rings 264 and 266 are fixed to the support shaft 240 via the key 11.

The periphery of the pressured roll 24 including the periphery of the pressure member 26 are wrapped in an independently rotatable endless belt 25 made of a soft and strong resin, fiber, leather or metallic material.

A worm gear 166 is attached to the shaft end 244 of the support shaft 240 on the side of the stand 14. And by operating the handwheel 167*a* or motor (not shown in Figs.) which drives the worm 167 engaged with the worm gear, the pressure member 26 is rotated to adjust the point of contact between the pressure member 26 and the work or workpiece even during the forming operation under a squeezing pressure.

In the preferred embodiment described above, the pressure member 26 consists in a steel plate having a crescent moon cross section. Yet the cross section of the pressure member 26 can be of any similar shape if it has a different radius of curvature partly or wholly. In addition to the above, the shape of the cross section, though not illustrated here, can be a roll, semicircle, U, V or flat, or a shape combining them or having any of them partially. And this enables the forming of works circular with desired diameter, involute, spiral, elliptical, triangular or square with rounded corners and in other complex curves. In all these applications, too, the periphery of the pressured roll 24 including the periphery of the pressure member 26 are wrapped in an endless belt of the aforesaid material.

The operational procedure for the preferred embodiment described above is as follows:

First the drop end member 56 is set into motion by operating the fluid pressure cylinder, which results in the upper part of the member holding the bearings 246*a* provided on the shaft end 246 of the support shaft 240 for the pressured roll 24. Then the fluid pressure cylinder is further operated to move the pressure roll 22 upward, so that the pressure roll 22 presses against the endless belt 25 wrapping the pressured roll 24. Now the front end of a work is placed at the point of pressure contact between the endless belt 25 and the pressure roll 22 and then the pressure roll 22 is rotated by running the motor. This will cause the work to be drawn in between the endless belt 25 and the pressure roll 22 and simultaneously both the endless belt 25 and pressured roll 24 begin rotating. As the rotation continues, the work will emerge from the opposite side, bent in such an arc as wraps about the pressured roll 24 which is covered by the endless belt 25. At this point, however, due to the presence of the pressure member 26 covered by the endless belt 25, the work is unbended to a certain degree as it continues to form an arc wrapping about the pressured roll 24 covered by the endless belt 25.

The next preferred embodiment of this invention described below covers the same application area and problems to solve as the preferred embodiment described above but features a pressured roll which itself has a varying radius of curvature.

Figure 5:
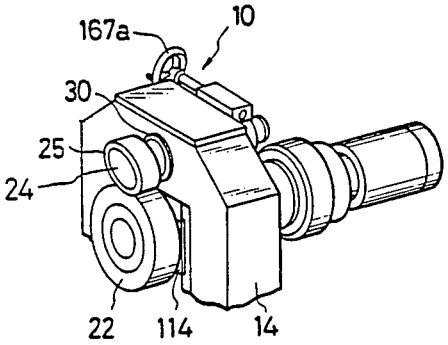
FIG. 5 is a perspective view showing another embodiment of the roll bending machine of this invention.
Figure 6:
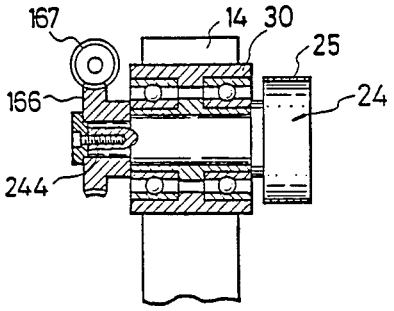
FIG. 6 is a section view of the roll bending machine shown in FIG. 5.
Figure 9:
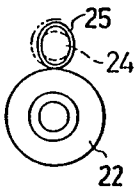
FIG. 8 and FIG. 9 are also schematic illustrations representing the cases where the support member of the pressured roll uses the part of the intermediate and the minimum radius of curvature, respectively.
Figure 8:
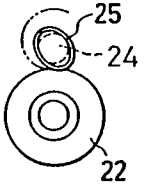
Figure 7:
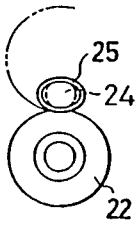
FIG. 7 is a schematic illustration showing the relationship between pressure roll and pressured roll of the roll bending machine shown in FIG. 5. This figure represents the case in which the support member of the pressured roll uses the part of the maximum radius of curvature.

FIG. 5 and FIG. 6 illustrate such a preferred embodiment of this invention. And FIGS. 7 to 9 represent the application examples of such a pressured roll having different radii of curvature.

Referring to FIG. 5 and FIG. 6, there is shown a two-roll bending machine 10, which comprises a urethane rubber coated pressure roll 22 in the lower position, a rigid pressured roll 24 itself having a varying radius of curvature, an endless belt 25 and a stand 14.

The pressure roll 22 is rotatably supported by the roller bearing fitted in the sliding support member 114. This member 114, which can freely slide up and down, is supported by the guide rails provided in the stand 14. The sliding support member 114 supporting the pressure roll 22 is operated up or down by a fluid pressure cylinder, and the pressure roll 22 is rotated by a motor.

The pressured roll 24 of steel features an elliptical cross section, thus having a varying radii of curvature and is wrapped in an independently rotatable endless belt 25 made of a soft and strong compound material using resin, fiber, leather, metal, etc.

The shaft end 244 of the pressured roll 24 passes through the bearing housing 30 provided in the stand 14 and is engaged with the worm gear 166. As the worm 167 is turned, the pressured roll 24 rotates so that the point of contact between the pressured roll 22 and the work is moved as is seen in FIGS. 7 to 9.

In the preferred embodiment described above, the pressured roll has an elliptical cross section. Yet the cross section of the pressured roll 26 can be of any similar shape if it has a varying radius of curvature partly or wholly. In addition to the above, the shape of the cross section, though not illustrated here, can be a semicircle, U, or a shape combining them or having any of them partially. And this enables the forming of works circular with desired diameter, involute, spiral, elliptical, triangular or square with rounded corners and in other complex curves.

The operational procedure for the preferred embodiment described above is as follows:

First, by operating the worm 167, a selection is made from the maximum, the minimum and the intermediate radius of curvature of the sectional form of the pressured roll 24 at the point of contact between the two rolls 24 and 22. Then the fluid pressure cylinder is operated to move the pressure roll 22 upward, so that the pressure roll 22 presses against the pressured roll 24. Now the front end of a work is placed at the point of pressure contact between the pressured roll 24 and the pressure roll 22, and then the pressure roll 22 is rotated by running the motor. This will cause the work to be drawn in between the pressured roll 24 and the pressure roll 22 and simultaneously the endless belt 25 of the pressured roll 24 begins rotating. As the rotation continues, the work will emerge from the opposite side, bent in such an arc as wraps about the pressured roll 24 which is covered by the endless belt 25.

The two-roll bending machine of the present invention selects the radius of curvature of the pressured roll at the point of contact with the work by rotating, or changing the position of, the pressured roll or the pressure member. This eliminates the need to prepare a number of pressured rolls as with the conventional two-roll bending machine, but enables the forming of products of different diameters by use of a single pressured roll.

Also, the two-roll bending machine of the present invention uses an endless belt of resin, fiber, leather or metallic material which covers the pressured roll and pressure member, so that the work makes only an indirect and continuous contact with the pressured roll and pressure member through the medium of the endless belt. This design prevents the pressure member from damaging the work and becoming worn.

Furthermore, the two-roll bending machine of the present invention has solved the aforesaid problems of the conventional system by providing an independently rotatable endless belt between the work and the pressure member which can slide together with the front end of the work over the pressure member when the former is in a position to hit the latter. Such problems as have been solved by the present invention include that of the front end of the work bumping into the pressure member thus impeding the forming operation, that of the shape and especially the position of the pressure member having their limitations which in turn limit the diameter of the formed products and that of the necessity to insert the work as far as where the front end of the work will not bump into the pressure member, before the squeezing pressure is applied between pressure roll and pressured roll, or to move the pressure member to a raised position and then bring it down into contact with the work after the front end of the work has passed it, to avoid collision between the front end of the work and the pressure member.

Also in accordance with the present invention, proper adjustment of pressures between the pressure roll and the pressured roll as well as the pressure member in combination with proper selection of the radius of curvature of the pressured roll as well as the pressure member at the point of contact with the work enables the forming of products in such shapes as circular with desired diameter, involute, spiral, elliptical, triangular or square with rounded corners and in other complex curves.

It must be noted, however, that even when the system of the preferred embodiment as represented in FIGS. 1 to 4 is used, the formed products can sometimes fail to show uniformity in their finish due to the unevenness of strength in the works, which can be plywood or some other material with a hole or holes, and the formed products of extremely small diameters or high accuracy requirements sometimes fall short of the expectations. Yet, these problems of the preferred embodiment shown in FIGS. 1 to 4 are solved by the other preferred embodiment of the present invention shown in FIGS. 5 to 9, in which the radius of curvature of the pressured roll at the point of contact with the work is changed as required so that the formed products display uniform finish and satisfy the required diameter or other dimensional accuracy.

What is claimed is:

1. A roll bending machine for bend forming a workpiece, comprising:

a pressure roll having a first axis;

means for supporting said pressure roll for rotation about said first axis;

a pressured roll having a second axis and having portions with different radii of curvature arched about said second axis;

an independently rotatable endless belt covering said pressured roll, and rotatable on said portions of said pressured roll about said second axis;

means for supporting said pressured roll in opposed relation to said pressure roll, so as to permit a workpiece to be formed to be drawn between said pressured roll and said pressure roll with rotation of said pressure roll in contact with said pressure roll and with said rotatable endless belt at a position opposed to one of said portions of said pressured roll with different radii of curvature, said pressure roll and said portions of said pressured roll cooperating such that a workpiece drawn through said rolls is caused to wrap about said pressured roll in an arc; and means for adjusting the location of contact of the workpiece with said endless belt among the positions opposing said portions of said pressured roll with different radii of curvature whereby the curvature of the arc of the workpiece to be formed is correspondingly changed.

2. A machine as in claim 1, wherein said pressured roll is formed of a cylindrical member and a pressure member having said portions of different radii of curvature on said cylindrical member to define said portions of said pressured roll with different radii of curvature.

3. A roll bending machine, as in claim 2, wherein said pressure member has a cross section which is one of crescent-moon shaped, roll shaped, semicircle shaped, U shaped, V shaped and flat shaped.

4. A roll bending machine, as in claim 1, wherein said pressured roll has a cross section which is one of elliptical shaped, semicircle shaped and U shaped.

5. A machine as in claim 2, wherein said adjusting means comprises means for rotating said pressure member relative to said second axis.

6. A machine as in claim 2, wherein said adjusting means comprises means for rotating said pressure member relative to said second axis while the workplace is being drawn between said pressure roll and said pressured roll, thereby to vary the curvature of the workpiece as it is formed.

7. A machine as in claim 1, wherein said endless belt is has a continuous surface surrounding said pressured roll so that the endless belt is contactable with the workpiece at any position of the endless relative to said second axis.

8. A machine as in claim 1, wherein said pressure roll has an elastic surface and said pressured roll has a rigid surface, thereby to facilitate bending of the workpiece about said pressured roller.

9. A machine as in claim 8, wherein said elastic surface comprises a coating of urethane rubber.

10. A machine as in claim 8, wherein said endless belt is formed of a soft and strong material.

11. A machine as in claim 10, wherein said material is one of a resin material, a fiber material, a leather material and a metallic material.

12. A machine as in claim 10, wherein said pressured roll has an entirely convexly shaped outer surface surrounding said second axis, said portions of different radii of curvature entirely surrounding said second axis.

13. A machine as in cliam 8, wherein said pressured roll has an entirely convexly shaped outer surface surrounding said second axis, said portions of different radii of curvature entirely surrounding said second axis.

14. A machine as in claim 1, wherein said endless belt is formed of a soft and strong material.

15. A machine as in claim 14, wherein said material is one of a resin material, a fiber material, a leather material and a metallic material.

16. A machine as in claim 1, wherein said pressured roll has an entirely convexly shaped outer surface surrounding said second axis, said portions of different radii of curvature entirely surrounding said second axis.

17. A machine as in claim 1, wherein said adjusting means comprises means for rotating said pressured roll relative to said second axis.

18. A machine as in claim 8, wherein said adjusting means comprises means for rotating said pressured roll relative to said second axis while the workpiece is being drawn between said pressure roll and said pressured roll, thereby to vary the curvature of the workpiece as it is formed.

19. A roll bending machine for bend forming a workpiece, comprising:

a pressure roll having a first axis;

means for supporting said pressure roll for rotation about said first axis;

a pressured roll having a second axis and having portions with different radii of curvature arched about said second axis, said pressure roll having an elastic surface and said pressured roll has a rigid surface;

an independently rotatable endless belt covering said pressured roll, and rotatable thereon on said portions of said pressured roll about said second axis;

means for supporting said pressured roll in opposed relation to said pressure roll, so as to permit a workpiece to be formed to be drawn between said pressured roll and said pressure roll with rotation of said pressure roll in contact with said pressure roll and with said rotatable endless belt at a position opposed to one of said portions of said pressured roll with different radii of curvature, said elastic surface of said pressure roll and said portions of said pressured roll cooperating such that a workpiece drawn between said rolls is caused to wrap about said pressured roll in an arc; and means for adjusting the location of contact of the workpiece with said endless belt among the positions opposing said portions of said pressured roll with different radii of curvature whereby the curvature of the arc of the workpiece to be formed is correspondingly changed, said adjusting means comprises means for rotating said portions of said pressured roll with different radii of curvature relative to said second axis while the workpiece is being drawn between said pressure roll and said pressured roll, thereby to vary the curvature of the workpiece as it is formed.

20. A machine as in claim 19, wherein said pressured roll is formed of a cylindrical member and a pressure member having portions of different radii of curvature on said cylindrical member to define said portions of said pressured roll with different radii of curvature, and said means for rotating said portions comprises means for rotating said pressure member relative to said second axis.

21. A machine as in claim 19, wherein said pressured member is integrally formed with said portions of said pressured roll with different radii of curvature and said means for rotating said portions comprises means for rotating said pressured roll about said second axis.

* * * * *